US007941878B1

(12) United States Patent
Truong

(10) Patent No.: US 7,941,878 B1
(45) Date of Patent: May 17, 2011

(54) SINK DRAIN SYSTEM

(76) Inventor: Daniel Danh Truong, Tampa, FL (US)

( * ) Notice: Subject to any disclaimer, the term of this patent is extended or adjusted under 35 U.S.C. 154(b) by 966 days.

(21) Appl. No.: 11/880,517

(22) Filed: Jul. 23, 2007

(51) Int. Cl.
*E03C 1/232* (2006.01)

(52) U.S. Cl. ..... 4/685; 4/689

(58) Field of Classification Search ..... 4/584, 685, 4/679

See application file for complete search history.

(56) References Cited

U.S. PATENT DOCUMENTS 2,452,367 A * 10/1948 Gangloff ..... 219/201
3,353,192 A * 11/1967 Christiansen ..... 4/692
3,578,026 A * 5/1971 Meyer, Jr. ..... 138/110
3,857,184 A * 12/1974 Burkin et al. ..... 33/563
3,860,978 A * 1/1975 Wirth ..... 4/679
4,223,702 A * 9/1980 Cook ..... 138/106
4,380,834 A * 4/1983 Wentz ..... 4/287
4,516,278 A 5/1985 Lamond
6,311,734 B1 * 11/2001 Petrovic ..... 138/110
6,543,470 B2 4/2003 Mans
7,325,260 B1 * 2/2008 Hoyt et al. ..... 4/615
2002/0120984 A1 * 9/2002 Gray et al. ..... 4/684

* cited by examiner

*Primary Examiner* — Gregory L Huson
*Assistant Examiner* — Karen Younkins
(74) *Attorney, Agent, or Firm* — Edward P Dutkiewicz

(57) ABSTRACT

A drain plug, a drain body and a drain pipe are fabricated of a flexible material. The drain plug has perforations and is threaded to allow easy cleaning. A drain-trap-shaped drain pipe containment device is in the form of a pair of mirror image halves with a hinge means there between. The hinged halves are latched together.

3 Claims, 4 Drawing Sheets

SINK DRAIN SYSTEM

BACKGROUND OF THE INVENTION

1. Field of the Invention

The present invention relates to a sink drain system and more particularly pertains to an improvement in drains commonly used in construction.

2. Description of the Prior Art

The use of drains, and drain components is known in the prior art. More specifically, drains, and drain components previously devised and utilized for the purpose of allowing a user to drain a sink are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,516,278 issued to Lamond on May 14, 1985 discloses a flexible plumbing trap. U.S. Pat. No. 6,543,470 issued to Mans on Apr. 8, 2003 discloses a flexible trap for drains.

While these devices fulfill their respective, particular objectives and requirements, the aforementioned patents do not describe sink drain system that allows an improvement in drains commonly used in construction.

In this respect, the sink drain system according to the present invention substantially departs from the conventional concepts and designs of the prior art, and in doing so provides an apparatus primarily developed for the purpose of an improvement in drains commonly used in construction.

Therefore, it can be appreciated that there exists a continuing need for a new and improved sink drain system which can be used for an improvement in drains commonly used in construction. In this regard, the present invention substantially fulfills this need.

SUMMARY OF THE INVENTION

In view of the foregoing disadvantages inherent in the known types of drains, and drain components now present in the prior art, the present invention provides an improved sink drain system. As such, the general purpose of the present invention, which will be described subsequently in greater detail, is to provide a new and improved sink drain system and method which has all the advantages of the prior art and none of the disadvantages.

To attain this, the present invention essentially comprises a sink drain system comprising several components, in combination.

First provided is a sink drain. The sink drain is coupled to a sink. The sink drain has an upper component with an upper flange. There is a passageway, having a first internal diameter with an internal thread, running through the upper component. The upper flange has an upper surface and a lower surface. The flange has a sink lip seal on the lower surface of the flange.

The sink drain also has a lower component. The lower component has an upper extent and a lower extent. The lower component has a flange. The lower component has a passageway, having the first internal diameter with an internal thread there through, running through the lower component.

Next provided is a drain plug. The drain plug has a generally round cylindrical, tubular configuration. The drain plug has a solid disk-shaped top portion, an intermediate portion, and a lower portion. The top portion is sized to be mated with, and received by, the first internal diameter of the upper flange of the sink drain.

The drain plug top portion has an externally threaded lower portion. The plug thread has a second diameter. The intermediate portion has an upper extent and a lower extent, with a length there between. The upper extent of the intermediate portion has an internal thread of the second diameter so as to mate with the plug thread. The length of the intermediate portion has a plurality of holes therein.

The lower portion of the drain plug is continuous with the lower extent of the intermediate portion. The lower portion has a tapered configuration with a control rod aperture located therein.

Next provided is a drain body. The drain body has an upper threaded coupling portion and a lower coupling portion. There is a major axis between the upper and lower coupling. The drain body also has a control rod housing located between the upper and lower coupling.

The upper coupling is sized to be received by, and mate with, the upper and lower components of the sink drain. The lower coupling has a round hollow tubular configuration of a third external diameter. The control rod housing has a hollow, round, tubular configuration with an innermost extent and an outermost extent. The innermost extent is continuous with the drain body and is oriented at an approximate right angle to the major axis of the drain body. The outermost extent of the control rod housing has a fourth internal diameter. The control rod housing has an associated rod ball. The rod ball has a fourth external diameter, with a control rod passing there through. The control rod is partially housed within the control rod housing. The control rod ball is contained within, and rotatably coupled to, the outermost extent of the control rod housing.

Next provided is a drain pipe. The drain pipe is fabricated of a flexible material. The drain pipe has an upper end, a lower end, and a length there between. The upper end of the drain pipe has a third internal diameter and is sized to be received by the lower extent of the drain body. The lower end of the drain pipe is sized to be coupled to an existing plumbing system of a house.

Lastly provided is a drain-trap-shaped drain pipe containment device. The drain pipe containment device has a pair of mirror image halves, with a hinge there between. The drain pipe containment device also has a latch.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved sink drain system which has all of the advantages of the prior art drains, and drain components and none of the disadvantages.

It is another object of the present invention to provide a new and improved sink drain system which may be easily and efficiently manufactured and marketed.

It is further object of the present invention to provide a new and improved sink drain system which is of durable and reliable constructions.

An even further object of the present invention is to provide a new and improved sink drain system which is susceptible of a low cost of manufacture with regard to both materials and labor, and which accordingly is then susceptible of low prices of sale to the consuming public, thereby making such sink drain system economically available to the buying public.

Even still another object of the present invention is to provide a sink drain system for an improvement in drains commonly used in construction.

Lastly, it is an object of the present invention to provide a new and improved sink drain system comprising a drain plug, a drain body and a drain pipe fabricated of a flexible material. The drain plug has perforations and is treaded to allow easy cleaning. A drain-trap-shaped drain pipe containment device is in the form of a pair of mirror image halves with a hinge means there between. The hinged halves are latched together.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
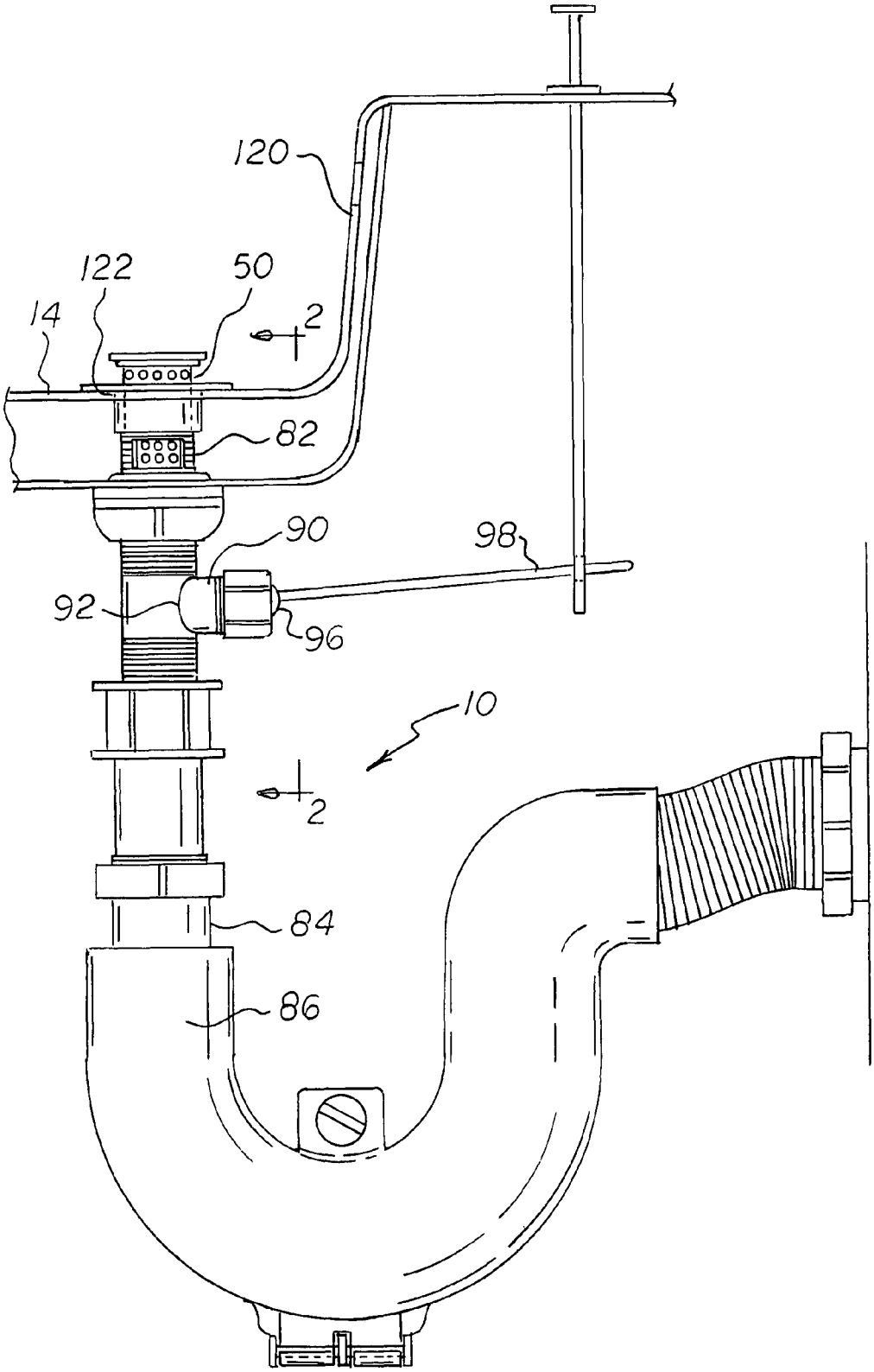
FIG. 1 is side elevation of the system employed with an existing sink.
Figure 2:
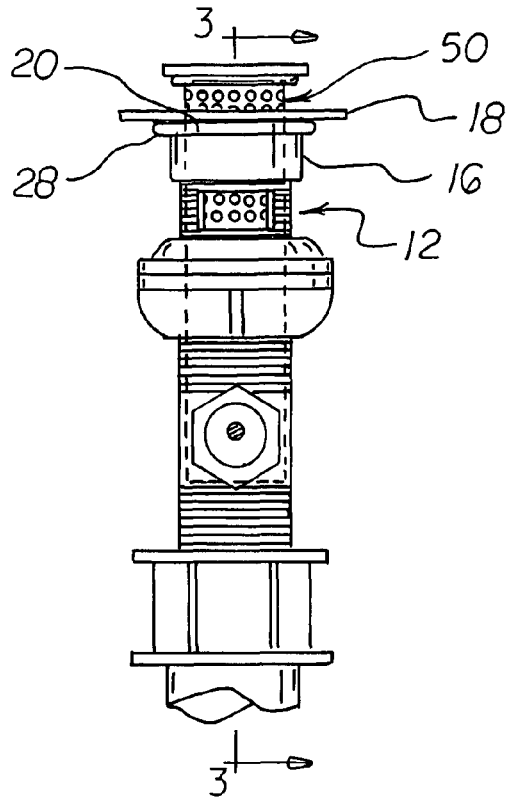
FIG. 2 is a close up front view elevation of the drain plug an sink drain. Note the see-through demonstrating the perforations.
Figure 3:
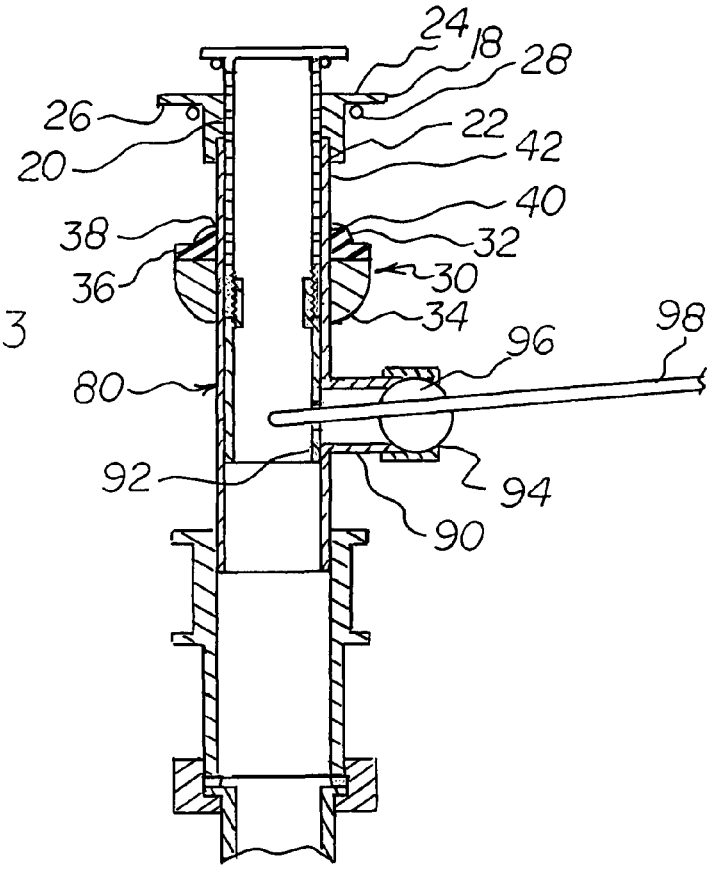
FIG. 3 is a cross sectional side view of FIG. 2 taken along line 3-3 of FIG. 2.
Figure 4:
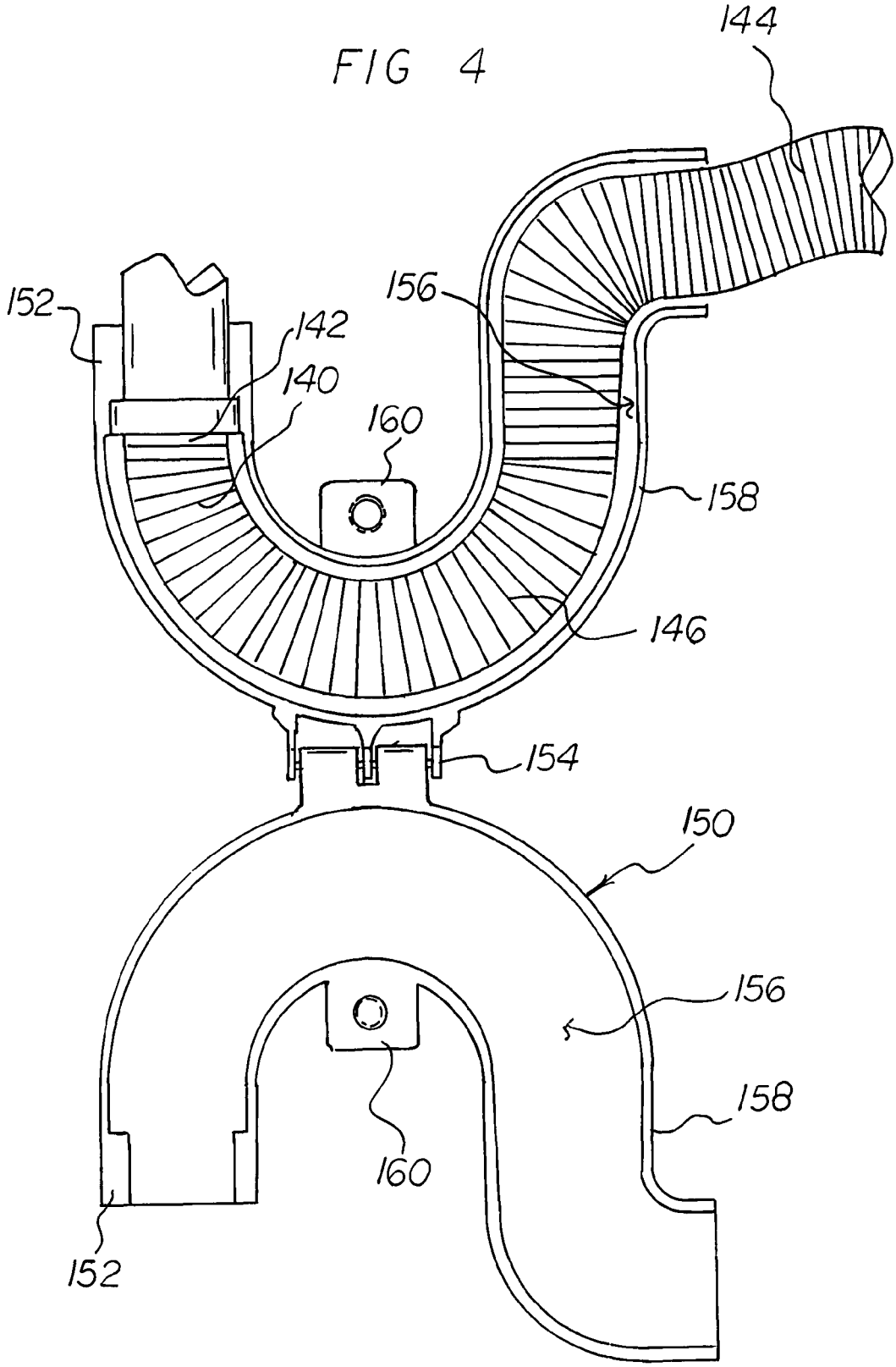
FIG. 4 is a view of the open drain trap clam shell, showing the mirror configurations and the hinge attachment. Note the attachment means for closing the clam shell and containing the flexible drain pipe in a trap configuration.
Figure 5:
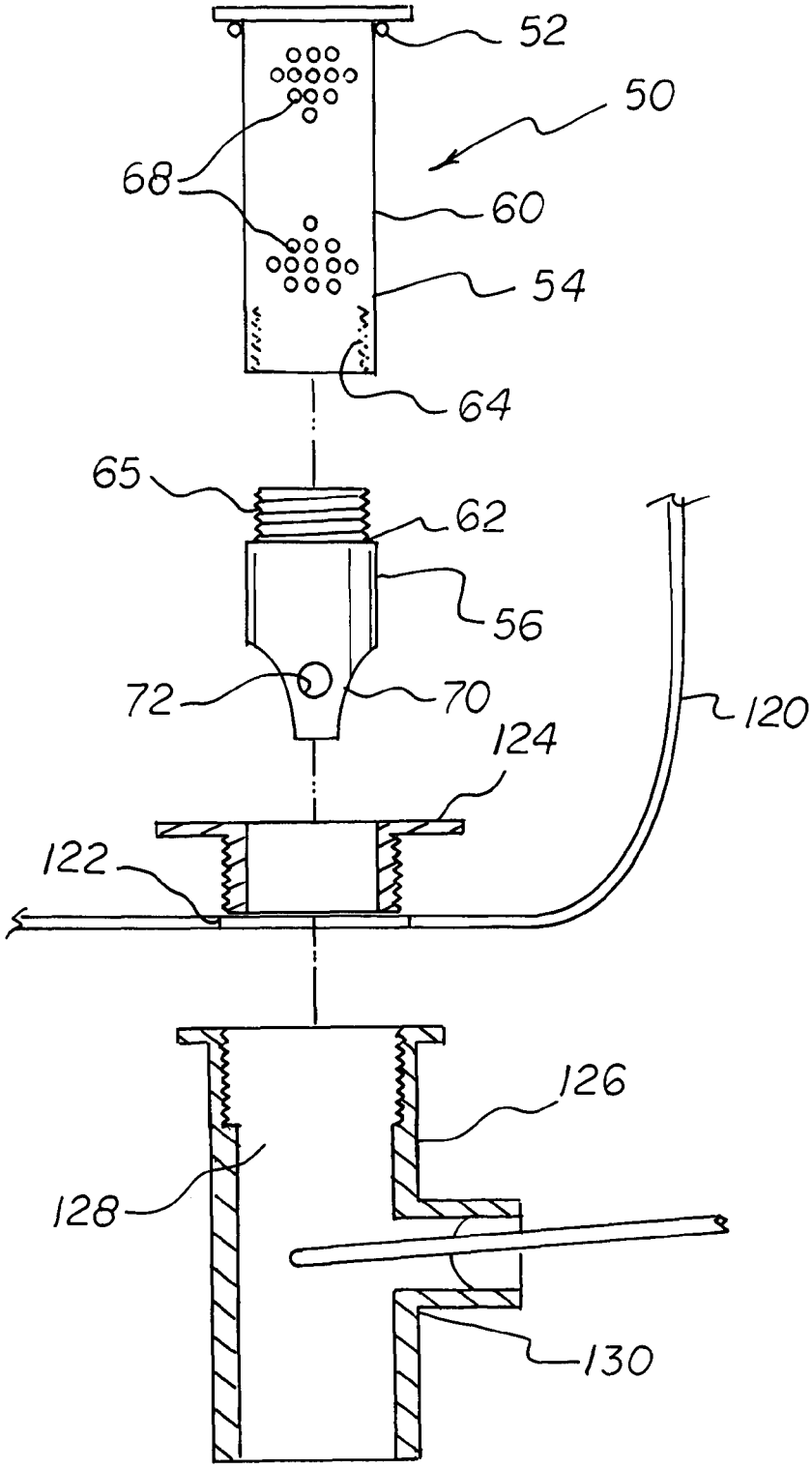
FIG. 5 is an exploded view of an alternate embodiment, where the lower component is included in the drain body.

With reference now to the drawings, and in particular to FIG. 1 thereof, the preferred embodiment of the new and improved sink drain system embodying the principles and concepts of the present invention and generally designated by the reference numeral 10 will be described.

The present invention, the sink drain system 10 is comprised of a plurality of components. Such components in their broadest context include a sink drain, a drain body, a drain plug, a flexible drain pipe, and a drain-trap-shaped drain pipe. Such components are individually configured and correlated with respect to each other so as to attain the desired objective. A sink drain system 10 comprising several components, in combination.

First provided is a sink drain 12. The sink drain may be made of any rigid material, natural or synthetic. Plastics, metals, or composites may be used. In the preferred embodiment the sink drain is made of plastic. The sink drain is coupled to a sink 14. The sink drain has an upper component 16 with an upper flange 18. This is also referred to as the sink drain upper flanged portion. There is a passageway 20, having a first internal diameter with an internal thread 22, running through the upper component. The upper flange has an upper surface 24 and a lower surface 26. The flange has a sink lip seal 28 on the lower surface of the flange.

In alternate embodiments the lip seal may be omitted.

The sink drain also has a lower component 30. The lower component has an upper extent 32 and a lower extent 34. The lower component has a flange 36. This is also referred to as the sink drain lower flanged portion. The lower component has a passageway 38, having the first internal diameter with an internal thread 40 there through, running through the lower component.

Next provided is a drain plug 50. The drain plug has a generally round cylindrical, tubular configuration. The drain plug has a solid disk-shaped top portion 52, an intermediate portion 54, and a lower portion 56. The top portion is sized to be mated with, and received by, the first internal diameter of the upper flange of the sink drain.

The intermediate portion of the drain plug has an upper portion 60 and a lower portion 62 with a length there between. There is a female thread 64 on the upper portion and there is male thread 65 on the lower portion. The female 64 and male 65 threads are mate-able to each other, so as to allow the intermediate portion to be taken apart and inspected or cleaned.

The upper portion of the intermediate portion of the drain plug has a plurality of holes 68 therein.

The lower portion of the drain plug is continuous with the lower extent of the intermediate portion of the drain plug. The lower portion has a tapered 70 configuration with a control rod aperture 72 located therein.

Next provided is a drain body 80. The drain body has an upper threaded portion forming coupling 82 and a lower coupling region 84. There is a major axis 86 between the upper and lower coupling. The drain body also has a control rod housing 90 located between the upper and lower coupling.

The upper threaded portion forming the upper coupling of the drain body is sized to be received by, and mate with, the threads of the sink drain upper flanged portion and the lower sink drain flanged portion. The lower coupling of the drain body has a round hollow tubular configuration of a third external diameter. The lower coupling portion is usually a site for a compression joint or slip fit into a drain pipe of a plumbing system of a structure.

The control rod housing 90 has a hollow, round, tubular configuration with an innermost extent 92 and an outermost extent 94. The innermost extent is continuous with the drain body and is oriented at an approximate right angle to the major axis of the drain body. The outermost extent of the control rod housing has a fourth internal diameter. The control rod housing has an associated rod ball 96. The rod ball has a fourth external diameter, with a control rod passing there through. The control rod 98 is partially housed within the control rod housing. The control rod ball is contained within, and rotatably coupled to, the outermost extent of the control rod housing.

In another embodiment the sink drain and drain body may be coupled together through a sink drain opening or passageway with the drain body comprising a flange to mate with a lower surface of a sink. As is common in commercially available sinks 120, there is a drain aperture 122 for placement of a sink drain. In this embodiment the sink drain 124 is a single component and the drain body 126 is a separate component that is coupled to the sink drain. This embodiment allows for ease of manufacture and a decrease in cost of manufacture in that multiple pieces are reduced to two separate couple-able pieces. The coupling would be by way of compression fitting, treading the sink drain into the drain body. The drain body, of course, will have a passageway 128 and mounting location 130 for the control lever 132 as is present in the preferred embodiment.

Next provided is a drain pipe 140. The drain pipe is fabricated of a flexible material. The drain pipe has an upper end 142, a lower end 144, and a length 146 there between. The upper end of the drain pipe has a third internal diameter and is sized to be received by the lower extent of the drain body. The lower end of the drain pipe is sized to be coupled to an existing plumbing system of a house. It is significant that the drain pipe is flexible and that it be form-able into a variety of configurations.

Lastly provided is a drain-trap-shaped drain pipe containment device 150. The drain pipe containment device has a pair of mirror image halves 152, with a hinge 154 there between. Each half has a recess 156 with a contacting lip 158. The two halves of the containment device contact each other at the contacting lip. The recess is configured so that the halves together accept and retain a drainage pipe.

The hinge may, of course, be one of several hinging means to accomplish the rotation of the two halves about a point. Other hinging means include pins, tapes, wires, clips, living hinges, pin hinges, or hook and loop attachment. Of course, one skilled in the art would recognize that the hinge may be replaced by an attachment means, as discussed below. The drain pipe containment device also has a latch 160, or attachment means. The coupling of the two halves may be accomplished by a hinge and attachment means, or by two attachment means. In this context attachment means includes clips, wires, ties, straps, clamps, hook and loop material, screws, bolts and nuts, bolts with associated threaded apertures, wire hooks, and snaps.

In use, the flexible drain pipe is coupled to the sink drain and then placed within the drain pipe containment device. The flexible pipe conforms to, and is held within, the drain pipe containment device.

The containment device allows for the use of flexible tubing in the formation and construction of sink drains. Such use also allows a user to clear the trap of the drain by merely opening the clam-shell like containment device and moving the flexible pipe so as to drain the pipe. The pipe is then re-inserted into the clam-shell-like containment device and when the shell is closed, the flexible pipe is forced back into a drain trap configuration.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sink drain system comprising:

a drain pipe fabricated of a flexible material;

a sink drain coupled to a sink with the sink drain having an upper component with an upper flange having a passageway there through, the passageway having a first internal diameter with an internal thread there through, the sink drain also having a lower component having an upper extent and a lower extent, with the lower component having a flange on the upper extent, the flange having a passageway there through with the passageway having the first internal diameter with an internal thread there through;

a drain plug with the drain plug having a generally round cylindrical tubular configuration, the drain plug having a solid disk-shaped top portion and a intermediate portion and a lower portion;

a drain body with the drain body having an upper coupling and a lower coupling with a major axis there between, the drain body also having a control rod housing there between, the upper coupling being sized to be received by and mate with the lower extent of the lower component of the sink drain, the lower coupling having a round hollow tubular configuration of a third external diameter, the control rod housing having a hollow round tubular configuration with an innermost extent and an outermost extent;

the drain pipe having an upper end and a lower end and a length there between, the upper end of the drain pipe having a third internal diameter and sized to be received by the lower extent of the drain body, the lower end of the drain pipe being sized to be coupled to an existing plumbing system of a house; and, a drain-trap-shaped drain pipe containment device, the containment device having a pair of mirror image halves with a hinge means there between and a latching means, the drain-trap-shaped drain pipe containment device hinge means being a hinge and the latching means being a snap.

2. The sink drain system as described in claim 1 with the system further including;

the sink drain upper component flange having an upper surface and a lower surface, with the flange having a sink lip seal on the lower surface of the flange, the sink drain having an intermediary component for coupling the upper component flange and the lower component flange;

the drain plug top portion being sized to be mated with and received by the first internal diameter of the upper flange of the sink drain, the drain plug top having an externally threaded lower portion, the drain plug top lower portion thread having a second diameter, the intermediate portion having an upper extent and a lower extent with a length there between, the upper extent of the intermediate portion having an internal thread of the second diameter so as to mate with the drain plug top lower portion thread, the length of the intermediate portion having a plurality of holes therein, the lower portion of the drain plug being continuous with the lower extent of the intermediate portion, the lower portion of the drain plug having a tapered configuration with a control rod aperture located therein; and the drain body innermost extent being continuous with the drain body and being oriented at approximately a right angle to the major axis of the drain body, the outermost extent of the control rod housing having a fourth internal diameter, the control rod housing having an associated rod ball having a fourth external diameter with a control rod passing there through and being partially housed within the control rod housing, the control rod ball being contained within and rotatably coupled to the outermost extent of the control rod housing.

3. A sink drain system comprising, in combination:

a sink drain coupled to a sink, the sink drain having an upper component with an upper flange having a passageway having a first internal diameter with an internal thread there through, the upper flange having an upper surface and a lower surface, with the flange having a sink lip seal on the lower surface of the flange, the sink drain also having a lower component having an upper extent and a lower extent, with the lower component having a lower flange having a passageway having the first internal diameter with an internal thread there through, the sink drain having an tubularly configured externally threaded intermediary component for threadedly and adjustably coupling the upper flange and the lower flange, the intermediary component having the first diameter as the external diameter;

a drain plug having a generally round cylindrical tubular configuration, the drain plug having a solid disk-shaped top portion and a intermediate portion and a lower portion, the top portion being sized to be mated with and received by the first internal diameter of the upper flange of the sink drain, the drain plug top having an externally threaded lower portion, the drain plug top lower portion thread having a second diameter, the intermediate portion having an upper extent and a lower extent with a length there between, the upper extent of the intermediate portion having an internal thread of the second diameter so as to mate with the plug thread, the length of the intermediate portion having a plurality of holes therein, the lower portion of the drain plug is continuous with the lower extent of the intermediate portion, the lower portion having a tapered configuration with a control rod aperture located therein;

a drain body having an upper coupling and a lower coupling with a major axis there between, the drain body also having a control rod housing there between, the upper coupling being sized to be received by and mate with the lower extent of the lower component of the sink drain, the lower coupling having a round hollow tubular configuration of a third external diameter, the control rod housing having a hollow round tubular configuration with an innermost extent and an outermost extent, the innermost extent being continuous with the drain body and being oriented at approximate right angle to the major axis of the drain body, the outermost extent of the control rod housing having a fourth internal diameter, the control rod housing having an associated rod ball having a fourth external diameter with a control rod passing there through and being partially housed within the control rod housing, the control rod ball being contained within and rotatably coupled to outermost extent of the control rod housing;

a drain pipe fabricated of a flexible material, the drain pipe having an upper end and a lower end and a length there between, the upper end of the drain pipe having a third internal diameter and sized to be received by the lower extent of the drain body, the lower end of the drain pipe being sized to be coupled to an existing plumbing system of a house; and, a drain-trap-shaped drain pipe containment device, the containment device having a pair of mirror image halves with a hinge there between and a latch.

* * * * *